US010229568B2

(12) United States Patent
Man

(10) Patent No.: US 10,229,568 B2
(45) Date of Patent: Mar. 12, 2019

(54) ANTI-THEFT RFID SYSTEM AND METHOD THEREOF

(71) Applicant: Megabyte Limited, Hong Kong (HK)

(72) Inventor: Chun Sing Matthew Man, Hong Kong (HK)

(73) Assignee: Megabyte Limited, Hong Kong (HK)

( * ) Notice: Subject to any disclaimer, the term of this patent is extended or adjusted under 35 U.S.C. 154(b) by 0 days.

(21) Appl. No.: 16/117,000

(22) Filed: Aug. 30, 2018

(65) Prior Publication Data

US 2018/0374328 A1 Dec. 27, 2018

Related U.S. Application Data

(63) Continuation-in-part of application No. 13/479,286, filed on May 24, 2012, which is a continuation of application No. PCT/CN2010/077728, filed on Oct. 14, 2010.

(60) Provisional application No. 61/264,672, filed on Nov. 26, 2009.

(51) Int. Cl.
*G08B 13/24* (2006.01)

(52) U.S. Cl.
CPC ..... *G08B 13/2462* (2013.01); *G08B 13/2417* (2013.01); *G08B 13/2482* (2013.01); *G08B 13/2485* (2013.01)

(58) Field of Classification Search
None
See application file for complete search history.

(56) References Cited

U.S. PATENT DOCUMENTS 6,294,999 B1 * 9/2001 Yarin ..... A61J 7/0481 340/573.1
7,757,947 B2 * 7/2010 Reznik ..... H01Q 1/2216 235/384
8,020,768 B2 * 9/2011 Ramos-Elizondo ..... G06Q 10/087 235/385
2003/0231001 A1 * 12/2003 Bruning ..... H02J 7/0054 320/108
2006/0208859 A1 * 9/2006 Hougen ..... G06K 7/0008 340/10.1
2006/0244593 A1 * 11/2006 Nycz ..... A61F 2/4425 340/572.1
2007/0040682 A1 * 2/2007 Zhu et al. ..... G06Q 10/087 340/572.1

(Continued)

*Primary Examiner* — Thomas S McCormack

(57) ABSTRACT

An anti-theft RFID system for monitoring the presence of a plurality of tagged items includes an RFID reader including an antenna and being configured to transmit an interrogating signal to the RFID tags and retrieve data; a processor configured to process the data that the RFID reader retrieves from the RFID tags; and a display connected to the processor and configured to display a result processed by the processor. The processor is configured to update a first counter value indicating the number of tagged items located within a predefined area and to update a second counter value indicating the number of tagged items being taken away from the predefined area. The display is configured to display the values of the first and the second counters and thereby to assist an operator to determine the occurrence of a security event by analyzing the values of the first and the second counters.

20 Claims, 13 Drawing Sheets

(56) References Cited

U.S. PATENT DOCUMENTS

2007/0258535 A1* 11/2007 Sammel ..... G06K 7/0008
375/262
2008/0272914 A1* 11/2008 Murray ..... G06K 7/0008
340/572.1
2009/0058595 A1* 3/2009 Mainguet ..... G06F 21/32
340/5.53

* cited by examiner

ANTI-THEFT RFID SYSTEM AND METHOD THEREOF

CROSS-REFERENCE TO RELATED APPLICATIONS

This application is a Continuation-In-Part Application of U.S. patent application Ser. No. 13/479,286 filed on May 24, 2012, which is a Continuation Application of PCT Application No. PCT/CN2010/077728 filed on Oct. 14, 2010, which claims the benefit of U.S. Provisional Application No. 61/264,672, filed on Nov. 26, 2009; the contents of which are hereby incorporated by reference.

FIELD OF THE PATENT APPLICATION

The present patent application generally relates to anti-theft technologies and more particularly to an anti-theft RFID system and a method thereof.

BACKGROUND

Merchandise theft has reached a total of billions of US dollars every year. The amount of merchandise stolen by shoplifters and employees represents the majority of the total shrinkage. Therefore loss prevention can have its greatest impact by deterring would-be shoplifters and enabling merchandise recovery. Thieves tend to focus on small and easily-concealed, expensive, branded items that have considerable popular appeal and are easily re-sellable. Amongst the most vulnerable merchandise, small items such as branded watches and fine jewelry are always classified on the top few of the most attractive stolen products. There is no doubt that even a small single item being shoplifted in a luxury watch/jewelry shop will cost a big loss to the shop. It is absolutely intolerable of one case from happening. Unfortunately, even though significant innovations are taking place in the industry, there are not many new and effective solutions available today, spreading from comprehensive product protection strategies to state-of-the-art shrink management systems. In particular, holistic system approach in integrating shoplifting prevention into the branded item retailer work mode is rarely found in the market.

SUMMARY

The present patent application is directed to an anti-theft RFID system for monitoring the presence of a plurality of tagged items, each of the tagged items being attached to an RFID tag. In one aspect, the anti-theft RFID system includes an RFID reader, the RFID reader including an antenna and being configured to transmit an interrogating signal to the RFID tags and retrieve data from the RFID tags through the antenna; a processor connected to the RFID reader and configured to process the data that the RFID reader retrieves from the RFID tags; and a display connected to the processor and configured to display a result processed by the processor. The processor is configured to update a first counter value indicating the number of tagged items located within a predefined area and to update a second counter value indicating the number of tagged items being taken away from the predefined area. The display is configured to display the values of the first and the second counters and thereby to assist an operator to determine the occurrence of a security event by analyzing the values of the first and the second counters.

The processor and the display may be integrated into a mobile computer. The display may be a touch screen display. The anti-theft RFID system may further include a battery pack connected to the processor. The RFID reader, the processor and the display are powered by the battery pack. The anti-theft RFID system may further include a wireless battery charger connected to the battery pack. The wireless battery charger is configured to charge the battery pack wirelessly.

The anti-theft RFID system may further include a panic button connected to the processor. The panic button is configured to be pushed by the operator when the operator determines a security event has occurred and thereby to trigger a predefined alert and a predetermined authentication procedure.

The processor may be connected to a remote computer and monitored thereby. The RFID reader may be installed under a fixed platform or embedded in a movable container and thereby invisible from an outer appearance. The processor may be configured to reset the first counter and the second counter after the operator determines no security event has occurred during a predefined session.

In another aspect, the present patent application provides a method for detecting a security event for a plurality of tagged items, each of the tagged items being attached to an RFID tag. The method includes transmitting an interrogating signal to the RFID tags and retrieving data from the RFID tags; processing the data retrieved from the RFID tags; and displaying a result of the processing. The step of processing the data retrieved from the RFID tags includes updating a first counter value indicating the number of tagged items located within a predefined area, updating a second counter value indicating the number of tagged items being taken away from the predefined area, and determining the occurrence of a security event by comparing the value of the first counter with an expected value and comparing the value of the second counter with zero.

The method may further include generating a predefined alert and initiating a predetermined authentication procedure after determining a security event has occurred during a predefined session. The method may further include remotely and concurrently monitoring and processing the data retrieved from the RFID tags at multiple locations. The method may further include after determining no security event has occurred during a predefined session, resetting the first counter and the second counter.

In yet another aspect, the present patent application provides an anti-theft RFID system for monitoring the presence of a plurality of tagged items, each of the tagged items being attached to an RFID tag. The anti-theft RFID system includes an RFID reader, the RFID reader including an antenna and being configured to transmit an interrogating signal to the RFID tags and retrieve data from the RFID tags through the antenna; a processor connected to the RFID reader and configured to process the data that the RFID reader retrieves from the RFID tags; and a display connected to the processor and configured to display a result processed by the processor. The processor is configured to update a first counter value indicating the number of tagged items located within a predefined area, to update a second counter value indicating the number of tagged items being taken away from the predefined area, to compare the value of the first counter with an expected value, and to compare the value of the second counter with zero so as to assist an operator to determine the occurrence of a security event. The display is configured to display the values of the first counter and the second counter.

In a fourth aspect, the present application provides an anti-theft RFID system for monitoring presence of a plurality of merchant items during an in-store try-out process in a store selling the items, each of the items being attached to an RFID tag, the anti-theft RFID system comprising: at least one movable container having a top surface;

a movable area designated on the top surface of the movable container within which the items are placed during the in-store try-out process;

an RFID reader embedded in the movable container, the RFID reader of the movable container comprising an antenna configured to transmit an interrogating signal to the RFID tags located on the movable area and retrieve data from the RFID tags located on the movable area through the antenna of the movable container;

a processor embedded in the movable container, connected to the RFID reader of the movable container and configured to process the data from the RFID tags located on the movable area; and a display embedded on the top surface of the movable container, connected to the processor of the movable container and configured to display a result processed by the processor of the movable container;

at least one fixed container having a top surface and matching with the least one movable container;

an RFID reader embedded in the fixed container, the RFID reader of the fixed container comprising an antenna configured to transmit an interrogating signal to the RFID tags in the fixed container and retrieve data from the RFID tags in the fixed container through the antenna of the fixed container;

a processor embedded in the fixed container, connected to the RFID reader of the fixed container and configured to process the data from the RFID tags in the fixed container; and a display embedded on the top surface of the fixed container, connected to the processor of the fixed container and configured to display a result processed by the processor of the fixed container;

the processor of the movable container is configured to continuously update a counter value of a first counter configured to indicate the number of tagged items newly put onto the movable area, and to continuously update a counter value of a second counter configured to indicate the number of tagged items being taken away from or put back onto the movable area in real time; and the display of the movable container is configured to continuously display current counter values of the first and second counters;

the processor of the fixed container is configured to continuously update a counter value of a third counter configured to indicate the number of tagged items newly taken out from the fixed container, and to continuously update a counter value of a fourth counter configured to indicate the number of tagged items being taken away from or put back onto the fixed container in real time;

the display of the fixed container is configured to continuously display current counter values of the third and fourth counters; and occurrence of a security event is determined by analyzing values of at least two of the first, second, third and fourth counters during the in-store try-out process.

In the anti-theft RFID system, an interface may be configured to cause at least one of the processor of the movable container and the processor of the movable container to determine the occurrence of the security event.

In the anti-theft RFID system, the at least one movable container may match with the at least one fixed container in one-to-one correspondence or in one-to-multiple correspondence.

In the anti-theft RFID system, the analysis on the values of the first, second, third and fourth counters may include: determining (1) whether the value of the first counter is equal to the value of the third counter, (2) whether the value of the second counter reads zero, and (3) whether the value of the fourth counter reads a default value.

In the anti-theft RFID system, the determination of whether the value of the first counter is equal to the value of the third counter, the determination of whether the value of the second counter reads zero, and the determination of whether the value of the fourth counter reads a default value may be independently performed anytime.

In the anti-theft RFID system, upon a condition that the second counter does not reads zero, the determination of whether the value of the fourth counter reads a default value may be further performed.

In the anti-theft RFID system, upon a condition that the fourth counter does not read the default value, the determination of whether the value of the second counter reads zero may be further performed and a reminder may be generated to remind a store staff to put the tagged items on the movable area into the fixed container.

In a fifth aspect, the present application provides a method for detecting a security event for a plurality of merchant items during an in-store try-out process in a store selling the items, each of the items being attached to an RFID tag, the method comprising:

continuously updating a counter value of a first counter configured to indicate the number of tagged items newly put onto a movable area on a top surface of at least one movable container, continuously updating a counter value of a second counter configured to indicate the number of tagged items being taken away from or put back onto the movable area in real time;

continuously updating a counter value of a third counter configured to indicate the number of tagged items newly taken out from at least one fixed container matching with the least one movable container, continuously updating a counter value of a fourth counter configured to indicate the number of tagged items being taken away from or put back onto the fixed container in real time; and determining occurrence of the security event by analyzing values of at least two of the first, second, third and fourth counters during the in-store try-out process.

BRIEF DESCRIPTIONS OF THE DRAWINGS

FIGS. 10A-D illustrate at least one movable container match with at least one fixed container in accordance with an embodiment of the present patent application.

DETAILED DESCRIPTION

Reference will now be made in detail to a preferred embodiment of the anti-theft RFID system and the method thereof disclosed in the present patent application, examples of which are also provided in the following description. Exemplary embodiments of the anti-theft RFID system and the method thereof disclosed in the present patent application are described in detail, although it will be apparent to those skilled in the relevant art that some features that are not particularly important to an understanding of the anti-theft RFID system and the method thereof may not be shown for the sake of clarity.

Furthermore, it should be understood that the anti-theft RFID system and the method thereof disclosed in the present patent application is not limited to the precise embodiments described below and that various changes and modifications thereof may be effected by one skilled in the art without departing from the spirit or scope of the protection. For example, elements and/or features of different illustrative embodiments may be combined with each other and/or substituted for each other within the scope of this disclosure.

Figure 1:
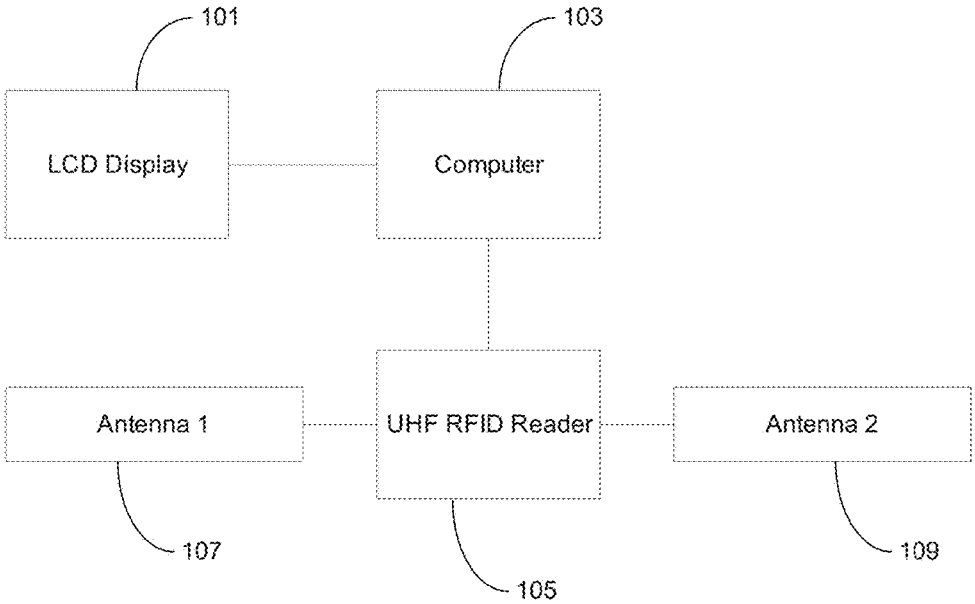
FIG. 1 is a block diagram of an anti-theft RFID system in accordance with an embodiment of the present patent application.

FIG. 1 is a block diagram of an anti-theft RFID system in accordance with an embodiment of the present patent application. The system includes a display (a LCD display 101 in the illustrated embodiment), a processor (a computer 103 in the illustrated embodiment) connected to the LCD display 101, an RFID reader 105 connected to the computer 103, at least one antenna connected to the RFID reader 105, so that RFID tags proximate to the system can be detected. In this embodiment, there are two antennas 107 and 109, respectively connected to the RFID reader 105 to ensure the read area coverage. The RFID reader 105 is an ultra-high frequency (UHF) RFID Reader. The LCD display 101 may be a touch screen LCD display.

In operation, the RFID reader 105, controlled by the computer 103, is configured to detect any RFID tags proximate thereto and interrogate the tags for retrieving data from the RFID tags. The RFID reader 105 is configured to send the data it retrieves from the RFID tags to the computer 103. The computer is configured to continuously monitor any change in the data.

In general, the anti-theft RFID system in this embodiment may be used in luxury shops. These shops typically do not prefer installing huge equipments and systems that are unmatched with the shop interior design. Therefore the anti-theft RFID system is designed in a way so that the whole setup is very small in size, which is feasible to lodge in the store in a hidden manner. The embodiment as illustrated in FIG. 1 can be seamlessly installed under the display shelves or fixed containers.

Figure 2:
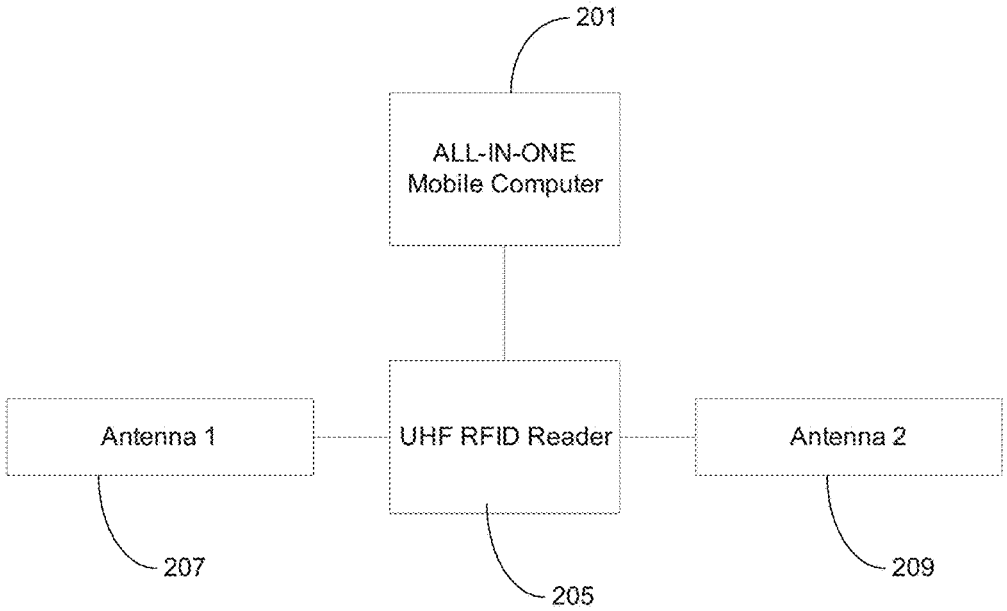
FIG. 2 is a block diagram of an anti-theft RFID system used in a mobile environment in accordance with another embodiment of the present patent application.

FIG. 2 is a block diagram of an anti-theft RFID system used in a mobile environment in accordance with another embodiment of the present patent application. In this embodiment, the display 101 and the processor 103 are embedded in an all-in-one mobile computer 201. In particular, the all-in-one mobile computer 201 includes a touch screen monitor. The whole setup should be able to operate with battery power supply or direct current (DC) power supply. This system can be lodged and embedded inside movable containers such as display trays, bins, boxes, etc.

Figure 3:
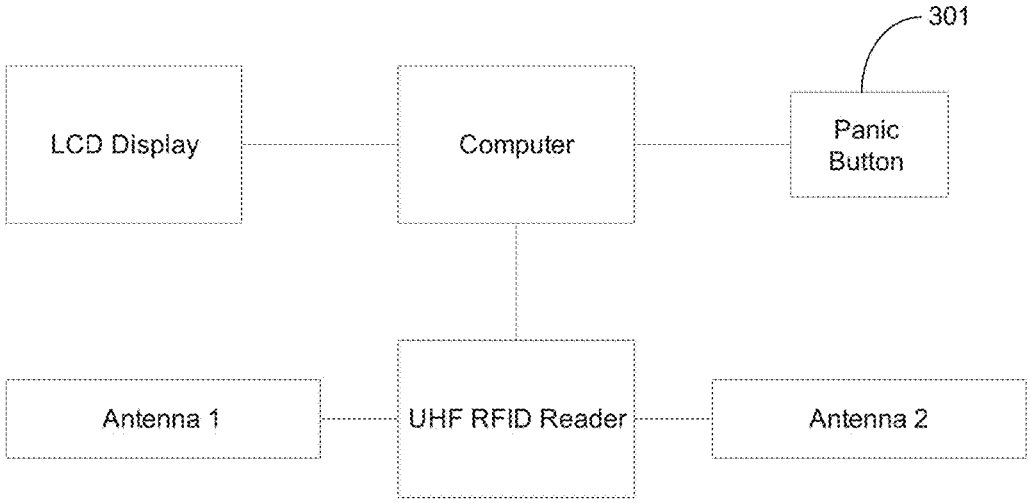
FIG. 3 is a block diagram of an anti-theft RFID system with a panic button for security purpose in accordance with yet another embodiment of the present patent application.

FIG. 3 is a block diagram of an anti-theft RFID system with a panic button for security purpose in accordance with yet another embodiment of the present patent application. In this embodiment, a predefined notification alert will be generated at the backend system when an operator determines a security event may have happened and presses the panic button 301.

Figure 4:
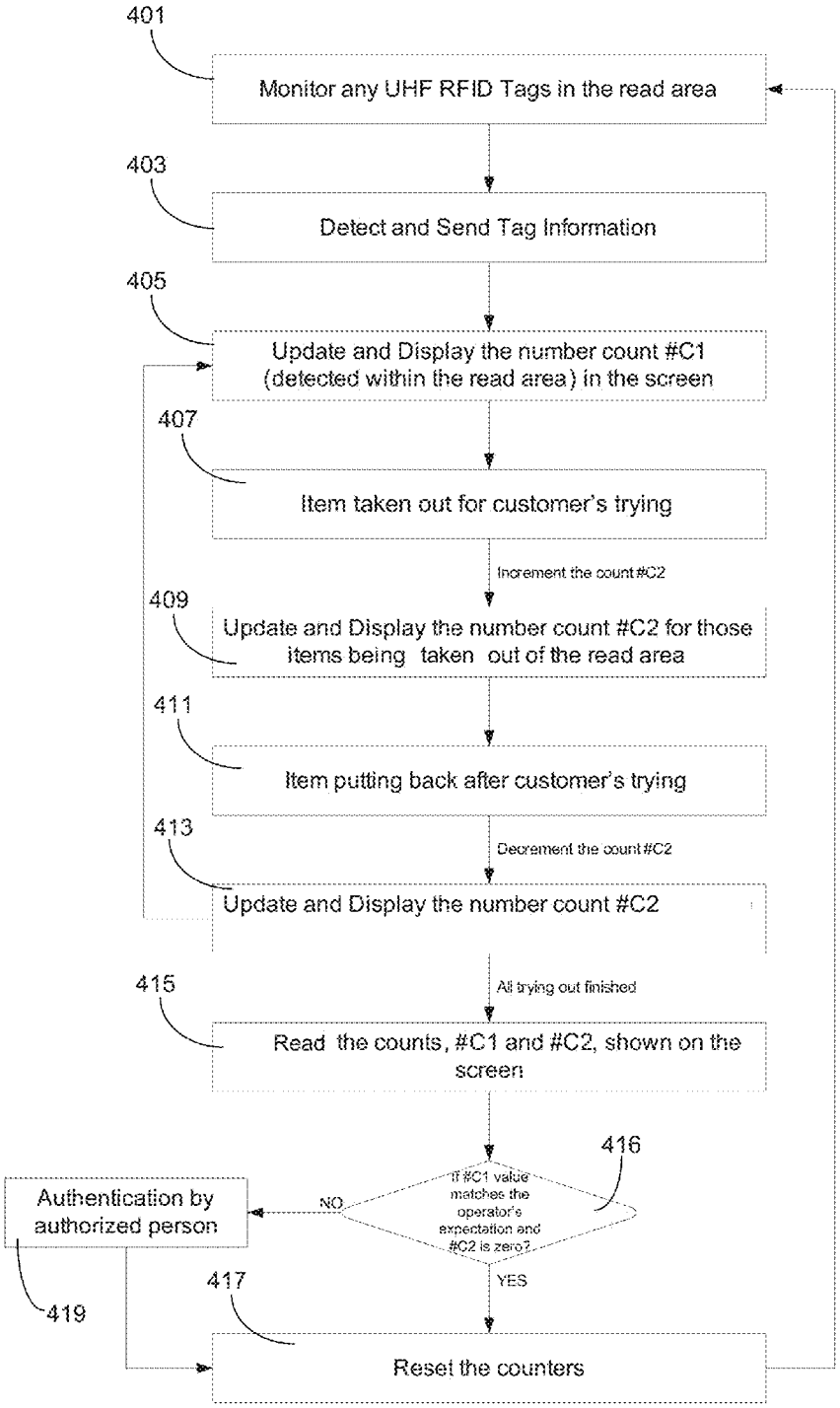
FIG. 4 is a flow chart illustrating the operation of the anti-theft RFID systems as depicted in FIG. 1 and FIG. 2.

FIG. 4 is a flow chart illustrating the operation of the anti-theft RFID systems as depicted in FIG. 1 and FIG. 2. An RFID tag is used to store a unique product identifier for a merchandize item in a luxury store environment. The RFID reader (105 or 205) is used to detect and read the tag information so that the detected luxury item is recognized. Each item is associated with an RFID tag.

Usually the luxury items are put inside the display shelves. They are taken out for customer try-out upon request. Initially, when a customer wants to try out some items such as fine jewelry or watches at a luxury store, the store staff will put these items onto a tray or a fixed area. For simplicity, the system in the embodiment for a mobile environment as depicted in FIG. 2 is used in this illustration. The antennas (207 and 209) and the whole setup are embedded within a movable tray. The same system flow applies when the setup is installed in fixed display shelves.

The antennas 207 and 209 installed in the tray are configured to monitor and detect the presence of the tagged items (Step 401). If the tag information is recognized, the RFID reader 205 will send the tag information to the computer 201 (Step 403). The computer 201 will update a counter (#C1) that is used to count the number of tagged merchandized items being detected over the tray, e.g. the total number of items on the tray in the beginning before any try-out (Step 405). This counter starts from zero and increases with the number of tagged merchandized items detected on the tray. The count is displayed on a touch-screen monitor included in the computer 201. During the trying out process, the item being tried out is taken out from the tray (Step 407). Then the system will detect that some RFID tagged items are out of the read area, i.e. the tray. The system will then update another counter (#C2) that is used to count the number of tagged merchandized items being taken out of the read area (Step 409). This count is also displayed in the small touch-screen monitor so as to give a clear comparison to the luxury store staff. This process continues while the customer tries out the items he/she likes. When the customer finishes trying out an item, the staff should put the item back onto the tray (Step 411). The counter (#C2) shall remove the details (RFID tag information) of the returned item or items from its counter value and display the updated counter value on the touch screen of the computer 201 (Step 413). The process continues until the customer finishes trying out all preferred items. In the end, the store staff should read the counter values of both counters #C1 and #C2 (Step 415). If the counter #C2 reads zero (0), then it means that all items being try-out are safely and properly collected back onto the tray. The counters will then be reset by the store staff (Step 417). Otherwise if counter #C2 is not zero, there may be some items not yet collected by the store staff or a shoplifting may have already occurred. In the case of a non-zero counter #C2 value, an internal store authentication procedure will be carried out (Step 419). An authorized person is required to present his/her card, which is also RFID enabled, over the tray and let the system counters reset. Other approach in authentication procedure can be defined according to the store policy.

In the middle of the customer's trying out process, new items, which are not put onto and hence detected by the tray in the beginning, are allowed to put onto the tray anytime. The aforementioned Step 401, 403 and 405 will follow so that the counter #C1 will increase to reflect the new items being detected on the tray.

In the above embodiment, if the value of the counter #C1 does not match the store staff's expectation or #C2 is not zero (Step 416), then a security event may have occurred and an internal store authentication procedure will be carried out (Step 419). It is understood that such analysis on the counter values of #C1 and #C2 may be conducted by the store staff or automatically by the computer 201.

In addition, the system may be configured to provide a monitoring feature so that the counter numbers displayed on the screen can be remotely monitored by a remote computer. In other words, a centralized computer can be used to monitor the actual happening in real time on every movable tray in the shop. The same monitoring feature applies when the setup is installed in fixed display shelves.

Figure 5:
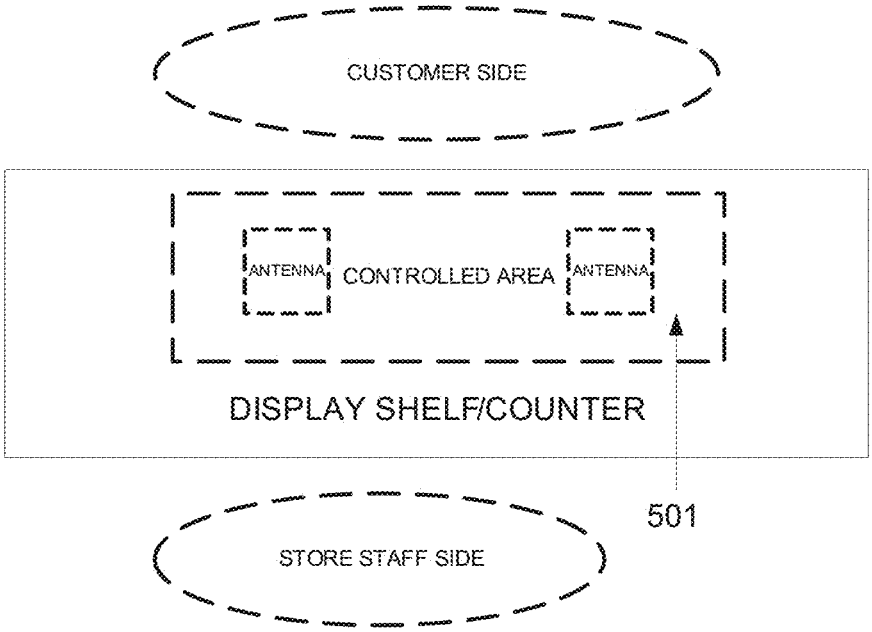
FIG. 5 is a top view of an anti-theft RFID system in accordance with still another embodiment of the present patent application.
Figure 6:
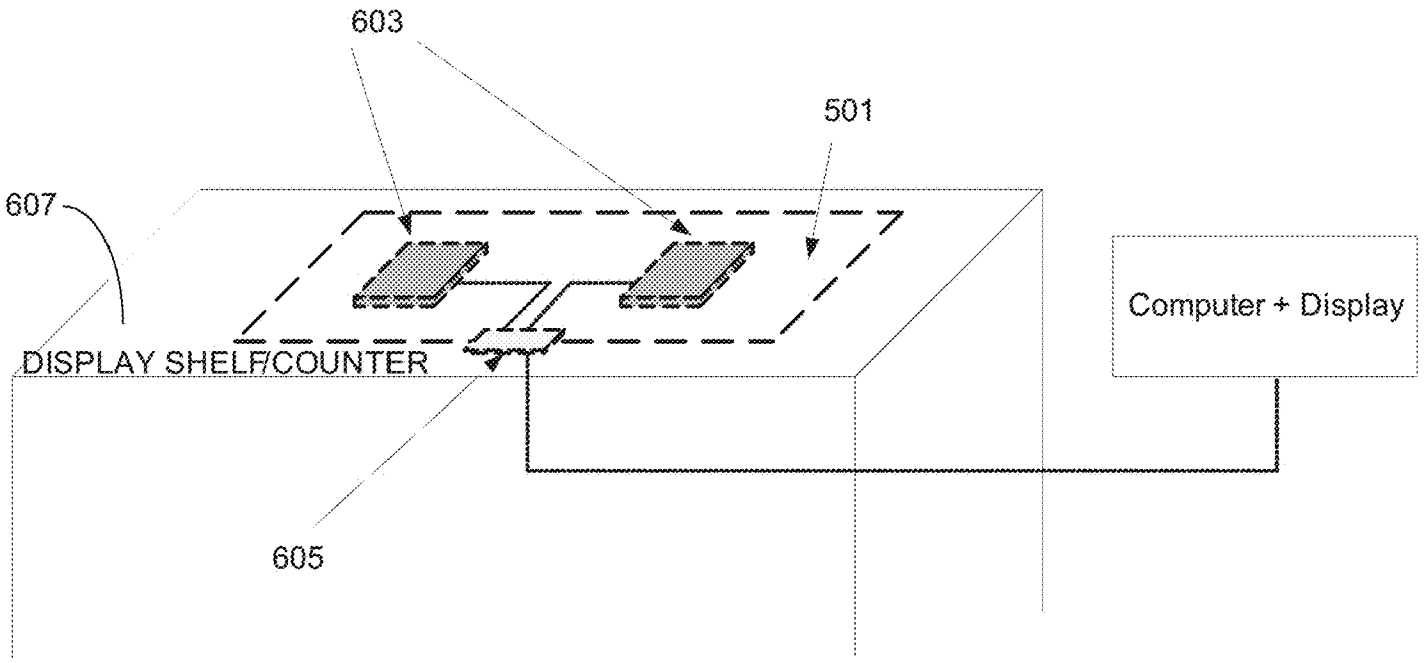
FIG. 6 is a perspective view of the anti-theft RFID system depicted in FIG. 5.

FIG. 5 is a top view of an anti-theft RFID system in accordance with still another embodiment of the present patent application. FIG. 6 is a perspective view of the anti-theft RFID system depicted in FIG. 5. FIG. 5 and FIG. 6 illustrate the physical installation of the system setup when they are applied in the fixed container or display shelf. Referring to FIG. 5, the luxury items are put on the display shelf or display counter before customer's trying out so that a defined area 501 on top of the display shelf can be assigned. This area 501 is a controlled area where the antennas and RFID reader are installed for detection of any tagged item being placed over there. The antennas and RFID reader are indeed embedded under the display shelf so that it is invisible to the customer. Any tagged item put in the controlled area 501 shall be detected by system. The computer and the display can be running in the same shelf counter area 501 or anywhere away from it. FIG. 6 illustrates the hiding of these setups and systems. The antennas 603 and the RFID reader 605 are hidden under the surface of display shelf or the display counter 607.

Figure 7:
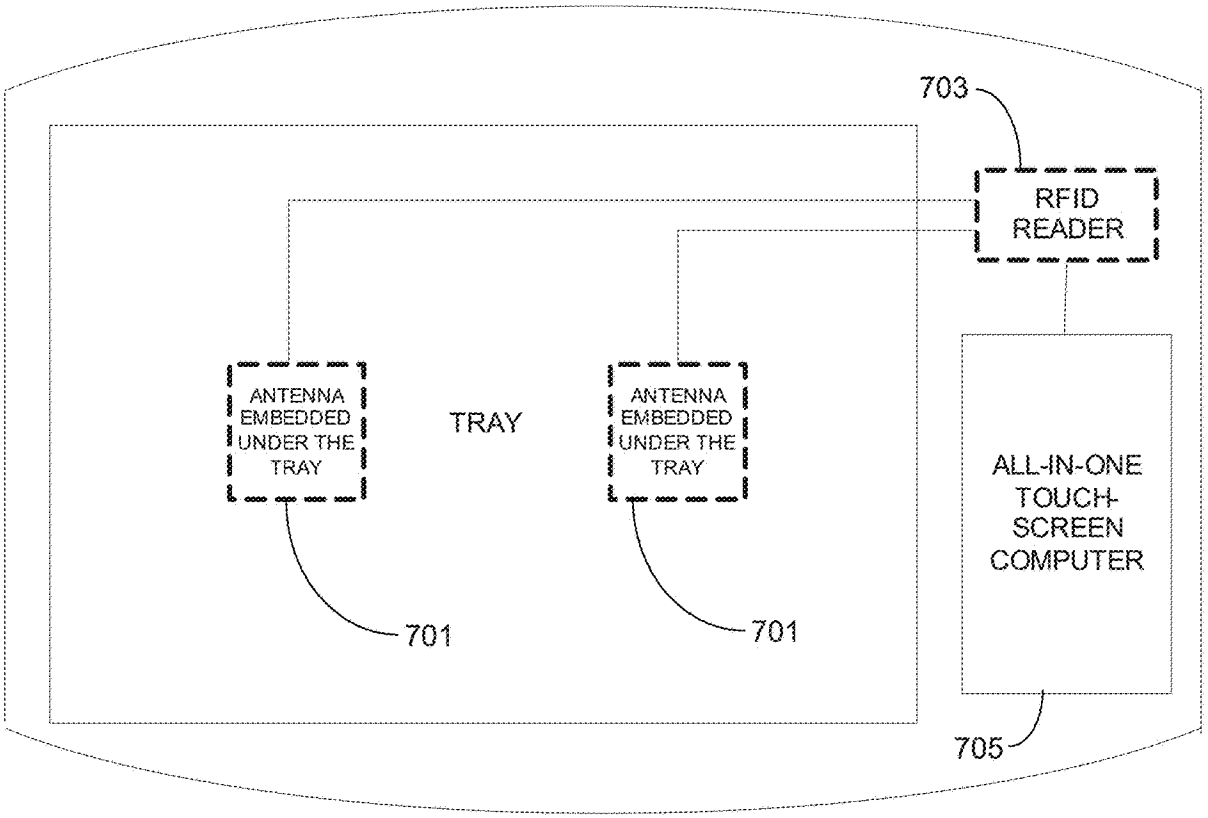
FIG. 7 is a top view of an anti-theft RFID system in accordance with still another embodiment of the present patent application.
Figure 8:
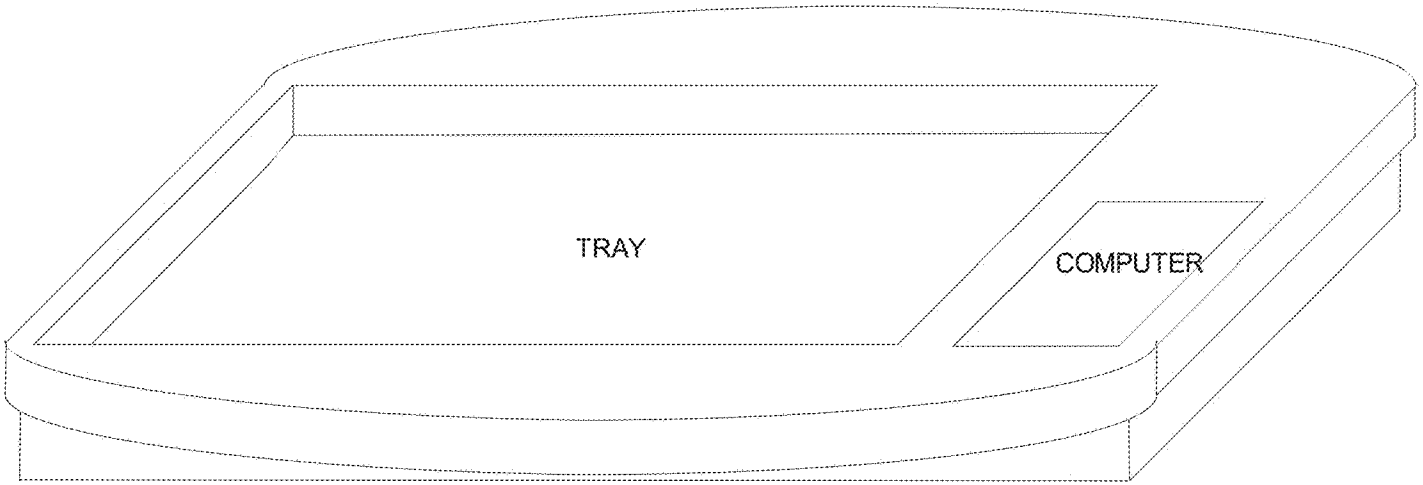
FIG. 8 is a perspective view of the anti-theft RFID system depicted in FIG. 7.

FIG. 7 is a top view of an anti-theft RFID system in accordance with still another embodiment of the present patent application. FIG. 8 is a perspective view of the anti-theft RFID system depicted in FIG. 7. FIG. 7 and FIG. 8 illustrate the physical installation of the system setup when they are applied in any movable containers, such as a tray in this embodiment. Referring to FIG. 7, the antennas 701 are installed under the tray surface so that when the tagged items are put inside the tray, they are detected by the antennas connected to the RFID reader 703. An all-in-one touch screen computer 705 is lodged to operate the system and display the results to the store staff. FIG. 8 illustrates the perspective view of the tray with RFID devices installed. The antennas and the RFID reader are invisible from the outer appearance of the tray. The same design applies to all other movable containers.

Figure 9:
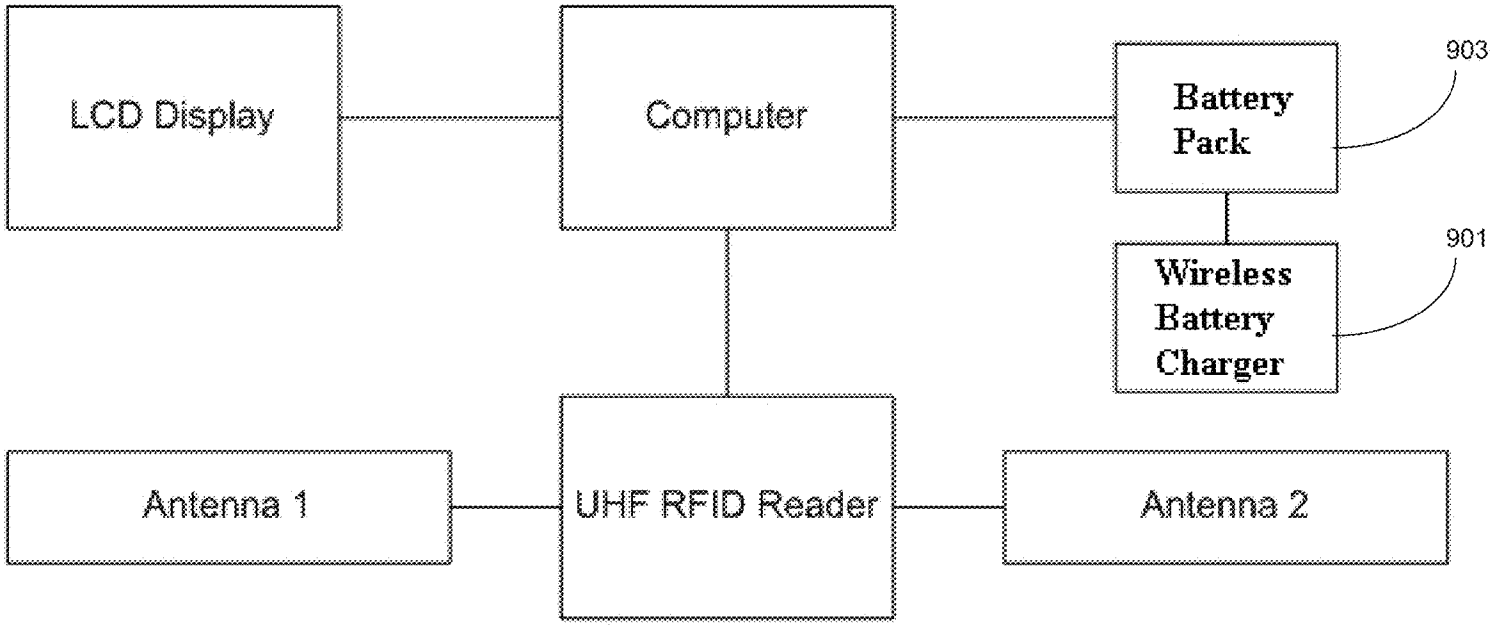
FIG. 9 is a block diagram of an anti-theft RFID system including a wireless charger adaptor for battery charging in accordance with still another embodiment of the present patent application.

FIG. 9 is a block diagram of an anti-theft RFID system including a wireless charger adaptor for battery charging in accordance with still another embodiment of the present patent application. In this embodiment, the system battery pack 903 can be recharged wirelessly by the wireless battery charger 901. The system should be able to operate under this battery power supply configuration with the battery power supply in the same way as in the aforementioned embodiments.

Figure 10A:
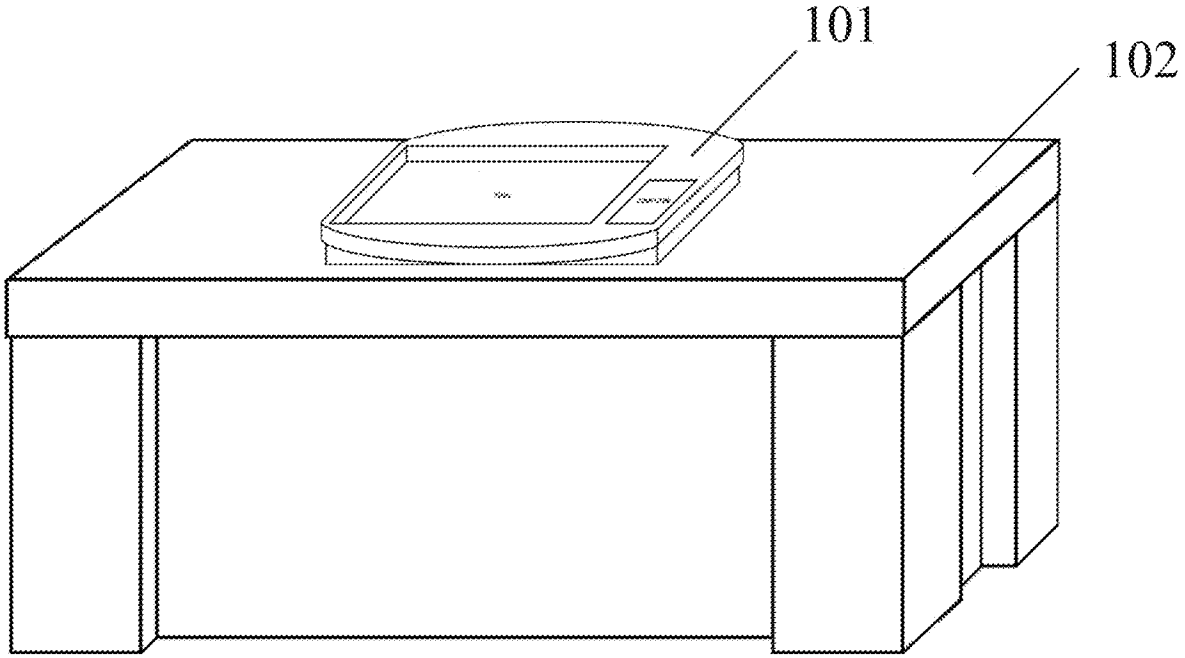

Furthermore, a movable container 101, e.g., a movable tray, may match with a fixed container 102, as shown in FIG. 10A. In the embodiment, a fixed container may refer to a showcase including a plurality of display shelves. As mentioned above, the luxury items are usually put inside the display shelves. They are taken out for customer try-out upon request. Initially, when a customer wants to try out some items such as fine jewelry or watches at a luxury store, the store staff will take out these items from the showcase and then may put them within a predefined area (called a movable area) on a top surface of the tray matching with the showcase. The structure of the system installed the movable tray is similar to that depicted in FIG. 2. For simplicity, the structure of the system as depicted in FIG. 2 is used in this illustration.

On the other hand, in the embodiment, the structure of the system installed in the showcase is similar to that depicted in FIG. 1. For simplicity, the structure of the system as depicted in FIG. 1 is used in this illustration.

The antennas 107 and 109 installed in the showcase are configured to monitor and detect the presence of the tagged items in the showcase. If the tag information is recognized, the RFID reader 105 will send the tag information to the computer 103. The computer 103 will update a counter (#C4) that is used to count the number of tagged merchandized items being taken out from and put into the showcase. When items are taken out from the showcase, the #C4 value will be decremented, while when items are put into the showcase, the #C4 value will be incremented. Before any try-out, the initial value of #C4 counter represents the total number of items exhibited in the showcase, which is called a default value thereof. The count is displayed on the LCD display 101.

The computer 103 will also update a counter (#C3) that is used to count the number of tagged merchandized items being newly taken out from the showcase, e.g. the total number of items taken out from the showcase in the beginning before any try-out. This counter starts from zero and increases with the number of tagged merchandized items newly taken out from the showcase. The count is also displayed on the LCD display 101.

The computer 201 will update a counter (#C1) that is used to count the number of tagged merchandized items being newly detected over the tray, e.g. the total number of items on the tray in the beginning before any try-out. This counter starts from zero and increases with the number of tagged merchandized items newly detected on the tray. The count is displayed on a touch-screen monitor included in the computer 201. #C1 value should be equal to #C3 value since any item newly taken out from the showcase should be put onto the tray.

During the trying out process, the item being tried out is taken out from the tray. The system will detect that some RFID tagged items are out of the tray. The system will then update another counter (#C2) that is used to count the number of tagged merchandized items being taken out of the tray. When items are taken out from the tray, the #C2 value will be decremented, while when items are put back onto the tray, the #C2 value will be incremented. This count is also displayed in the small touch-screen monitor so as to give a clear comparison to the luxury store staff. This process continues while the customer tries out the items he/she likes.

In the middle of the customer's trying out process, new items, which are not put onto and hence detected by the tray in the beginning, are allowed to put onto the tray anytime. The aforementioned Step will follow so that the counters #C1 and #C3 will increase to reflect the new items being detected on the tray and the corresponding items newly taken out from the showcase, respectively.

The process continues until the customer finishes trying out all preferred items. In the end, all the counter values may be read.

TABLE 1

| | #C1 | #C2 | #C3 | #C4 |
|---|---|---|---|---|
| Beginning | =0 | =0 | =0 | =Default value |
| Ending (correct) | =#C3 value | =0 | =#C1 value | =Default value |
| Ending (error) | ≠#C3 value | ≠0 | ≠#C1 value | ≠Default value |
| Reset | =0 | =0 | =0 | =Default value |

As illustrated in Table 1, analysis on the counter values of #C1, #C2, #C3 and #C4 includes three determinations: (1) whether #C1 value is equal to #C3 value, (2) #C2 value reads zero, and (3) #C4 value reads the default value. After the trying out process and before the counters are reset, the correct status is: #C1 value is equal to #C3 value, #C2 value reads zero, and #C4 value reads the default value. After the correct status is confirmed, the counters will then be reset by the store staff.

The three determinations may be independently performed anytime. For example, before the customer's trying out process, Determination 1 may be performed to determine whether all items newly taken out from the showcase are safely and properly put onto the tray. Determination 1 may also be performed in the end of the customer's trying out process. If the value of the counter #C1 does not match the #C3 value, a security event may have occurred and then an internal store authentication procedure will be carried out.

In Determination 2, if the counter #C2 does not reads zero (0), then it means that all items being try-out are not safely and properly collected back onto the tray. It is concluded that a security event may have occurred or some items being try-out may be directly put back into the showcase. Determination 3 may be further performed.

In Determination 3, if the counter #C4 does not read the default value, then it means that all items being taken out from the showcase are not safely and properly collected back into the showcase. It is concluded that a security event may have occurred or some items being taken out from the showcase may still be on the tray. Determination 2 may be further performed. A reminder may be generated to remind the store staff to put the items on the tray into the showcase.

It is understood that such analysis on the counter values of #C1, #C2, #C3 and #C4 may be conducted by the store staff or automatically by the computer 201 and computer 103.

An interface on computer or a touch PC program interface may be used as an indication of ending of a customer's trying out process. When the customer finishes his/her trying out process, the staff may trigger the interface, then the system determine whether a security event may have happened by determining the values of some or all of the counters. Once a security event is recognized, a predefined notification alert will be generated at the backend system.

Figure 10B:
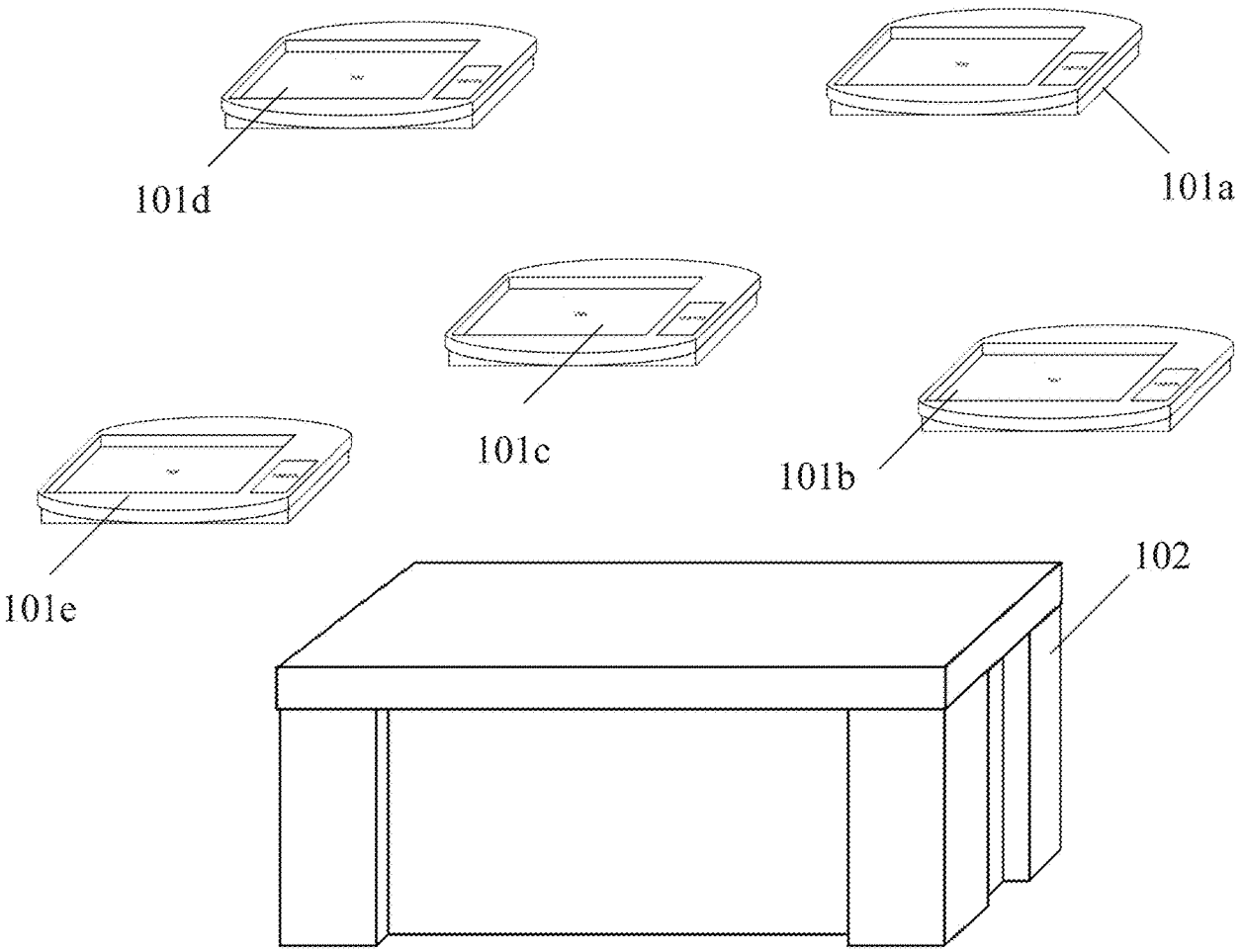
Figure 10C:
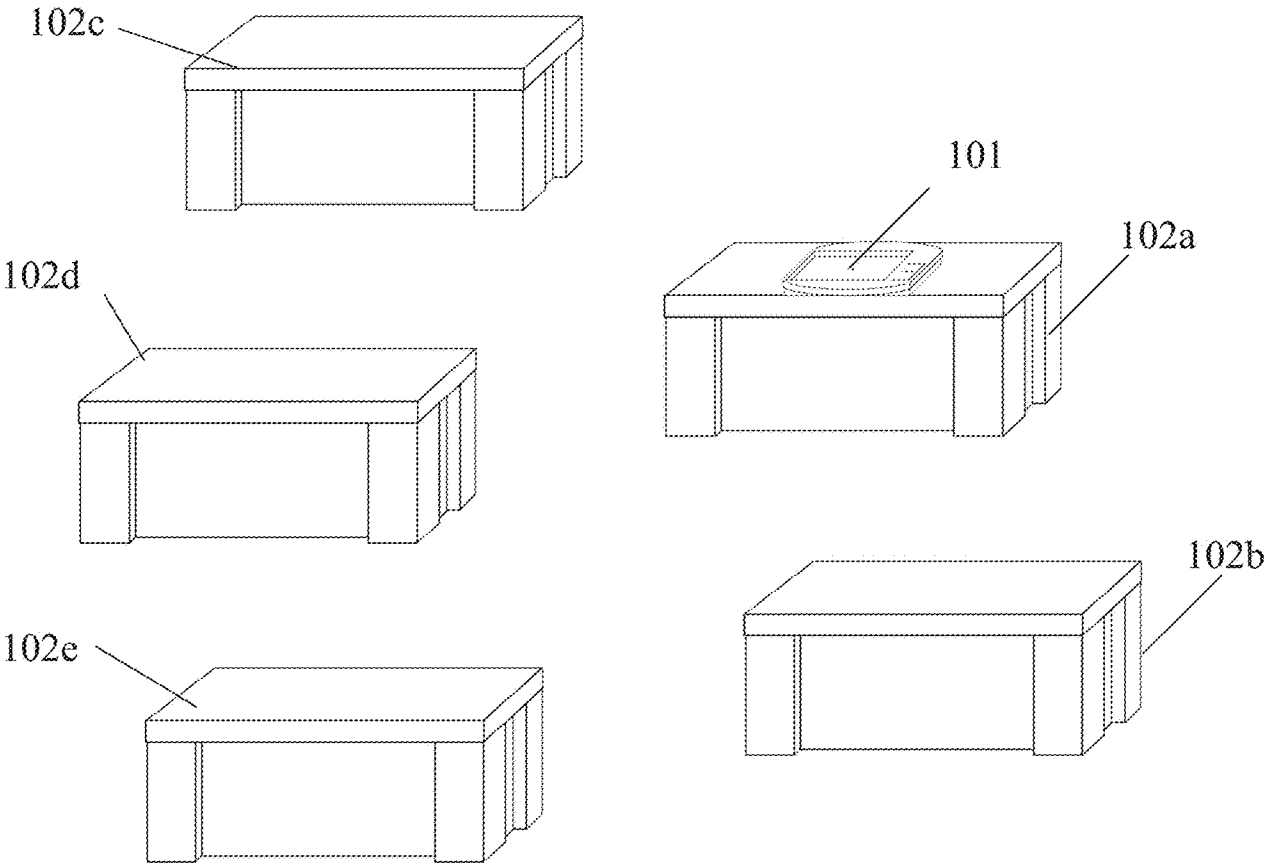
Figure 10D:
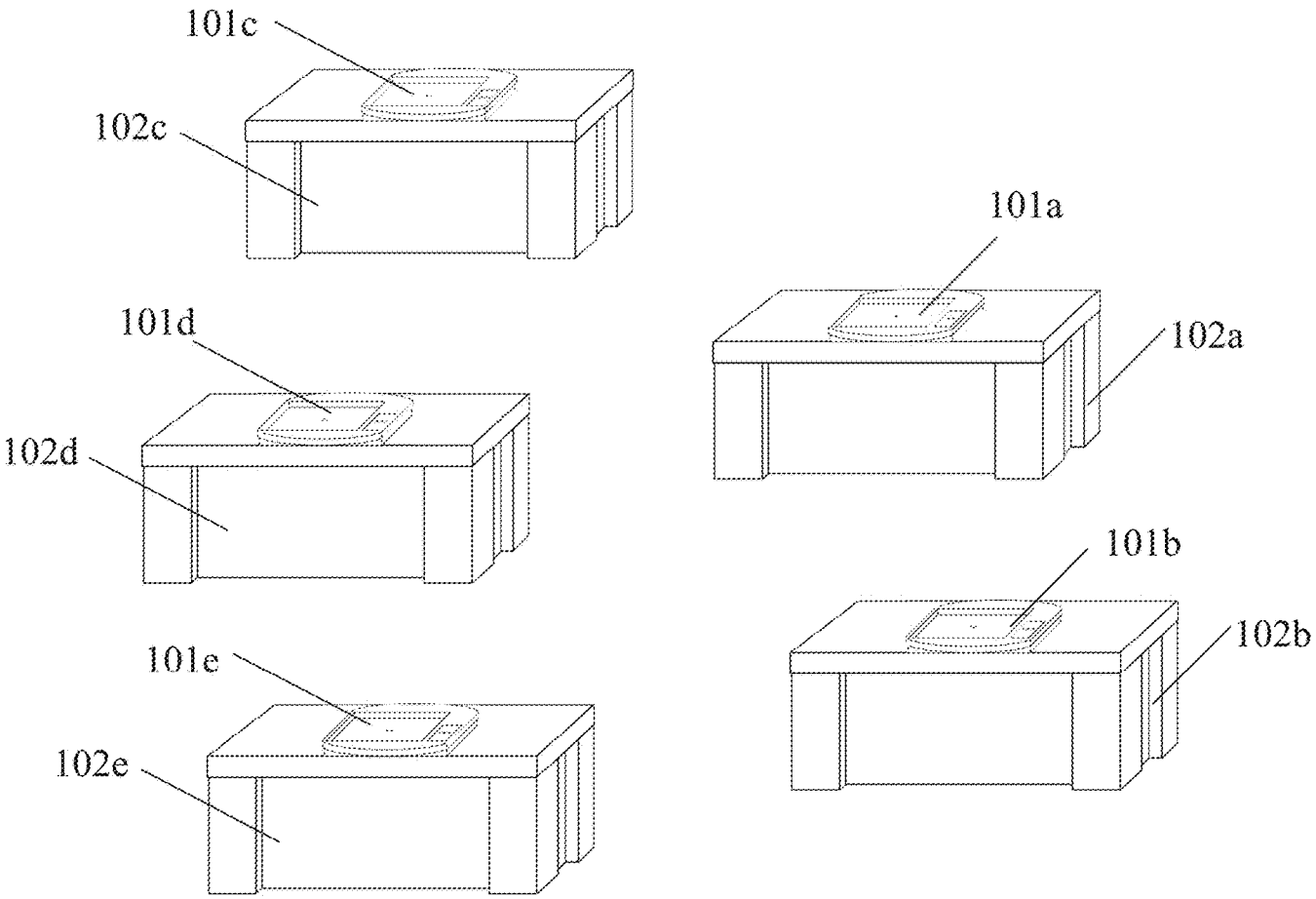

The movable container does not necessarily match with the fixed container in one-to-one correspondence. As shown in FIGS. 10B-D, a plurality of trays 101*a-e* may match with one showcase 102 (FIG. 10B), one tray 101 may match with a plurality of showcases 102*a-e* (FIG. 10C), or a plurality of trays 101*a-e* may match with a plurality of showcases 102*a-e* (FIG. 10D). In one-to-multiple correspondence, for example, when a plurality of trays 101*a-e* match with one showcase 102, the showcase 102 may provide with a plurality of #C3 and #C4 counters each corresponding to one tray. Once one tray is selected in the display of the showcase 102, the #C3 and #C4 counters corresponding to the selected tray will be displayed in the display of the showcase 102.

While the present patent application has been shown and described with particular references to a number of embodiments thereof, it should be noted that various other changes or modifications may be made without departing from the scope of the present invention.

What is claimed is:

1. An anti-theft RFID system for monitoring presence of a plurality of merchant items during an in-store try-out process in a store selling the items, each of the items being attached to an RFID tag, the anti-theft RFID system comprising:

at least one movable container having a top surface;

a movable area designated on the top surface of the movable container within which the items are placed during the in-store try-out process;

an RFID reader embedded in the movable container, the RFID reader of the movable container comprising an antenna configured to transmit an interrogating signal to the RFID tags located on the movable area and retrieve data from the RFID tags located on the movable area through the antenna of the movable container;

a processor embedded in the movable container, connected to the RFID reader of the movable container and configured to process the data from the RFID tags located on the movable area; and a display embedded on the top surface of the movable container, connected to the processor of the movable container and configured to display a result processed by the processor of the movable container;

at least one fixed container having a top surface and matching with the least one movable container;

an RFID reader embedded in the fixed container, the RFID reader of the fixed container comprising an antenna configured to transmit an interrogating signal to the RFID tags in the fixed container and retrieve data from the RFID tags in the fixed container through the antenna of the fixed container;

a processor embedded in the fixed container, connected to the RFID reader of the fixed container and configured to process the data from the RFID tags in the fixed container; and a display embedded on the top surface of the fixed container, connected to the processor of the fixed container and configured to display a result processed by the processor of the fixed container;

wherein the processor of the movable container is configured to continuously update a counter value of a first counter configured to indicate the number of tagged items newly put onto the movable area, and to continuously update a counter value of a second counter configured to indicate the number of tagged items being taken away from or put back onto the movable area in real time; and the display of the movable container is configured to continuously display current counter values of the first and second counters;

the processor of the fixed container is configured to continuously update a counter value of a third counter configured to indicate the number of tagged items newly taken out from the fixed container, and to continuously update a counter value of a fourth counter configured to indicate the number of tagged items being taken away from or put back onto the fixed container in real time;

the display of the fixed container is configured to continuously display current counter values of the third and fourth counters; and occurrence of a security event is determined by analyzing values of at least two of the first, second, third and fourth counters during the in-store try-out process.

2. The anti-theft RFID system of claim 1, wherein the processor of the movable container and the display of the movable container are integrated into a computer embedded in the movable container.

3. The anti-theft RFID system of claim 1, wherein the RFID reader of the movable container and the antenna of the movable container are configured to be invisible to the customer.

4. The anti-theft RFID system of claim 1, wherein the processor of the fixed container and the display of the fixed container are integrated into a computer embedded in the fixed container.

5. The anti-theft RFID system of claim 1, wherein the RFID reader of the fixed container and the antenna of the fixed container are configured to be invisible to the customer.

6. The anti-theft RFID system of claim 1, further comprising a battery pack connected to the processor of the movable container, wherein the RFID reader of the movable container, the processor of the movable container and the display of the movable container are powered by the battery pack.

7. The anti-theft RFID system of claim 6, further comprising a wireless battery charger connected to the battery pack, wherein the wireless battery charger is configured to charge the battery pack wirelessly.

8. The anti-theft RFID system of claim 1, further comprising a panic button connected to at least one of the processor of the movable container and the processor of the movable container, the panic button being configured to trigger a predefined alert and a predetermined authentication procedure when pushed.

9. The anti-theft RFID system of claim 1, wherein an interface is configured to cause at least one of the processor of the movable container and the processor of the movable container to determine the occurrence of the security event.

10. The anti-theft RFID system of claim 1, wherein the processor of the movable container and the processor of the movable container are connected to a remote and centralized computer and monitored thereby.

11. The anti-theft RFID system of claim 1, wherein the processor of the movable container is further configured to reset the first counter and the second counter.

12. The anti-theft RFID system of claim 1, wherein the processor of the fixed container is further configured to reset the third counter and the fourth counter.

13. The anti-theft RFID system of claim 1, wherein the at least one movable container matches with the at least one fixed container in one-to-one correspondence.

14. The anti-theft RFID system of claim 1, wherein the at least one movable container matches with the at least one fixed container in one-to-multiple correspondence.

15. The anti-theft RFID system of claim 1, wherein the analysis on the values of the first, second, third and fourth counters comprises: determining (1) whether the value of the first counter is equal to the value of the third counter, (2) whether the value of the second counter reads zero, and (3) whether the value of the fourth counter reads a default value.

16. The anti-theft RFID system of claim 15, wherein the determination of whether the value of the first counter is equal to the value of the third counter, the determination of whether the value of the second counter reads zero, and the determination of whether the value of the fourth counter reads a default value are independently performed anytime.

17. The anti-theft RFID system of claim 15, wherein upon a condition that the second counter does not reads zero, the determination of whether the value of the fourth counter reads a default value is further performed.

18. The anti-theft RFID system of claim 15, wherein upon a condition that the fourth counter does not read the default value, the determination of whether the value of the second counter reads zero is further performed and a reminder is generated to remind a store staff to put the tagged items on the movable area into the fixed container.

19. A method for detecting a security event for a plurality of merchant items during an in-store try-out process in a store selling the items, each of the items being attached to an RFID tag, the method comprising:

continuously updating a counter value of a first counter configured to indicate the number of tagged items newly put onto a movable area on a top surface of at least one movable container, continuously updating a counter value of a second counter configured to indicate the number of tagged items being taken away from or put back onto the movable area in real time;

continuously updating a counter value of a third counter configured to indicate the number of tagged items newly taken out from at least one fixed container matching with the least one movable container, continuously updating a counter value of a fourth counter configured to indicate the number of tagged items being taken away from or put back onto the fixed container in real time; and determining occurrence of the security event by analyzing values of at least two of the first, second, third and fourth counters during the in-store try-out process.

20. The method of claim 19, further comprising: after determining no security event has occurred during the in-store try-out process, resetting the first, second third and fourth counters.

* * * * *